United States Patent [19]

Donarummo

[11] 4,183,603

[45] Jan. 15, 1980

[54] EXTENSION CORD LOCK

[76] Inventor: Robert Donarummo, 15 Ridgewood St., East Northport, N.Y. 11731

[21] Appl. No.: 914,078

[22] Filed: Jun. 9, 1978

[51] Int. Cl.[2] ..... H01R 13/54

[52] U.S. Cl. ..... 339/75 P; 339/39; 339/103 R

[58] Field of Search ..... 339/103 R, 75 P, 91 R, 339/39

[56] References Cited

U.S. PATENT DOCUMENTS 2,720,633 10/1955 Westburg ..... 339/75 P 3,030,601 4/1962 Krebs ..... 339/75 P 3,475,716 10/1969 Laig ..... 339/75 P

*Primary Examiner*—E. F. Desmond

*Attorney, Agent, or Firm*—Richard L. Miller

[57] ABSTRACT

A simple clip for firmly holding together an electric plug and socket on separate extension cords, and prevent accidental disengagement thereof, particularly when the cords are being pulled or moved; the clip being generally U-shaped and made of rubber or plastic with holes through each end for the cords to pass therethrough, while the connecting plug and socket are located between the U-shaped ends.

1 Claim, 4 Drawing Figures

EXTENSION CORD LOCK

This invention relates generally to electrical accessories. More specifically it relates to electric extension cord accesories.

It is well known that many persons resort to tying or knotting the plugged together ends of two extension cords, so to prevent their accidental disengagement when being pulled about during use. This is a primitive method that takes time and effort to accomplish, and is accordingly in want of an improvement.

Therefore, it is a principal object of the present invention to provide a lock for interconnected extension cords which is quick for attachment or detachment of extension cords, and which is positively secure against accidental disconnection.

Another object is to provide an extension cord lock which is compact in size and neat in appearance.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
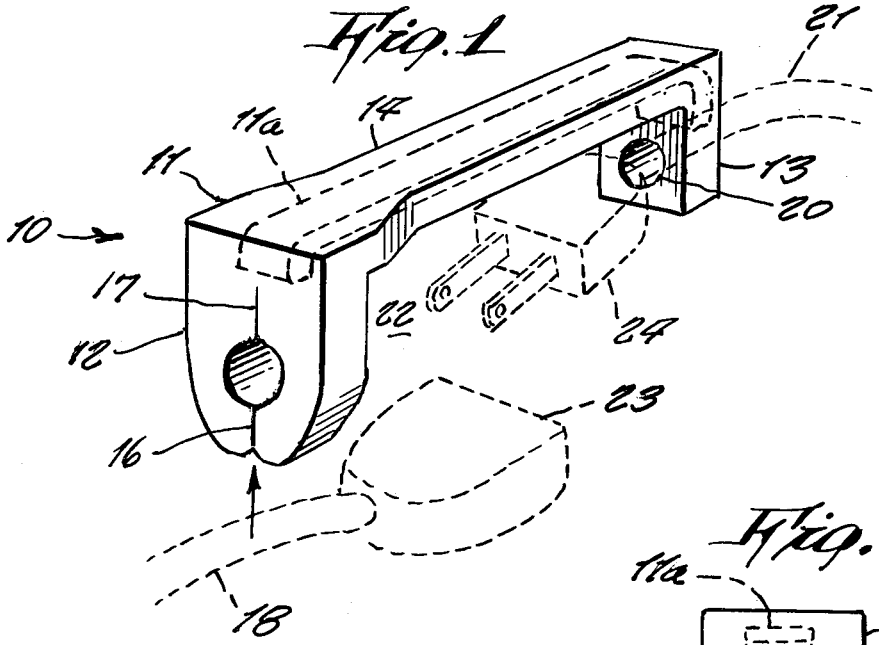
FIG. 1 is a perspective view of the invention.
Figure 2:
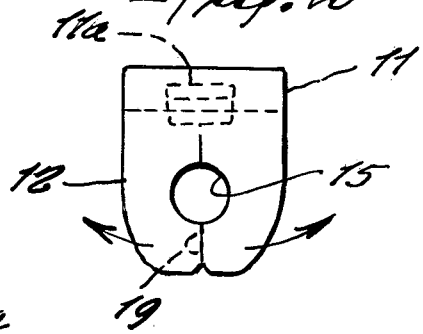
FIG. 2 is an end view.
Figure 3:
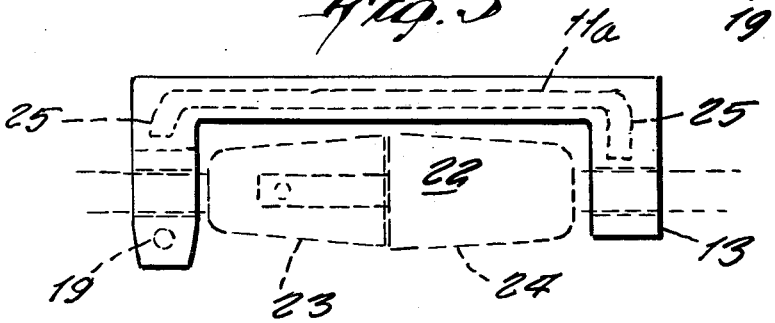
FIG. 3 is a side view.

Referring now to the drawing in greater detail, and more particularly to FIGS. 1 to 3 at this time, the reference numeral 10 represents an extension cord lock according to the present invention wherein the same comprises a generally U-shaped body 11 molded of a semi-hard, slightly flexible, rubber or plastic material and which has a stiff metal bar 11*a* imbedded therewith in having a generally same shape.

The body includes a pair of short, parallel end legs 12 and 13, and which are integral with opposite ends of an elongated, straight, intermediate leg 14 therebetween.

The leg 12 is molded with a circular opening 15 extending therethrough. A slit 16 extends from an outward end of the leg 12 and into the opening. A continuation 17 of the slit extends on a diametrically opposite side of the opening. The slits and opening thus bifurcates the leg into a pair of jaws that can be forced to spread apart in order that an extension cord 18 can be inserted through the slit 16 and into the opening 15, after which the jaws automatically close together again. A detent 19 is located along one wall of slit 16 for mating in a corresponding depression along the opposite wall of the slit, thus locking in the cord 18.

The leg 13 includes a circular opening 20 therethrough and which axially aligns with the opening 15. There are, however, no slits that communicate with the opening, nor detent, as described above, so the leg is made slightly shorter than leg 12. The opening 20 accordingly is made for a permanent installation of the lock 10 on an extension cord 21.

The entire lock measures about 4 inches long so that a space 22 is provided between the legs that is just big enough so to contain two interconnected plugs 23 and 24, in order that the plugs cannot disengage when their cords are pulled in opposite directions. Instead, the plugs abut the legs 12 and 13 preventing them from being pulled apart. As shown, one of the plugs in a male plug and the other is a female socket.

The stiffening bar 11 includes opposite ends 25 bent at right angles and extending down into the legs, so to aid stiffening the legs from flexing in a direction apart from each other. This bar is optional and may not be desirable.

Figure 4:
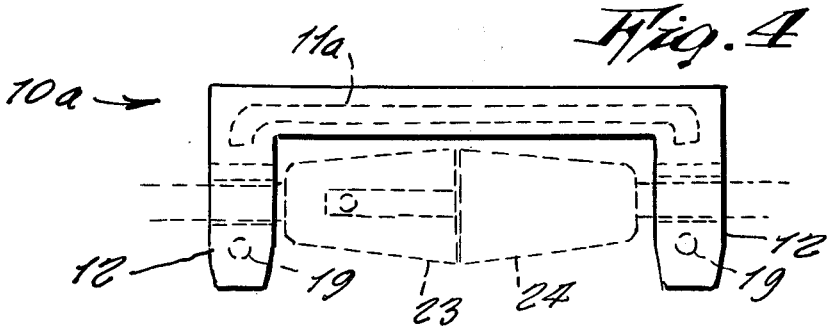
FIG. 4 is a side view of a modified construction thereof.

In FIG. 4, a modified design of lock 10*a* is the same as above described lock 10 except that both of the legs thereof are the same as above described leg 12, thus allow removal of the lock from both extension cords.

While certain novel features of this invention have beenshown and described and are pointed out in the annexed claims, it will be understood that various omissions, substitutions and changes in the forms and details of the device illustrated and in its operation can be made by those skilled in the art without departing from the spirit of the invention.

I claim:

1. A lock for a pair of interconnected extension cords, comprising in combination, a generally U-shaped body molded of a resilient material, and including a pair of parallel, opposite end legs and an intermediate leg therebetween, each said end leg having an opening therethrough for receiving an extension cord, said openings being axially aligned with each other, and a space between said end legs for containing interconnected plugs on ends of said extension cords; a generally U-shaped stiffening bar of metal being embedded inside said U-shaped body and extending longitudinally in all said legs; at least one said leg including a slit extending from an outer end thereof and through said opening so to form a pair of jaws for flexing apart so to insert said extention cord in said opening; and a detent along a portion of said slit between said hole and said leg outer end, said detent protruding from one said jaw and into a correspondingly shaped depression in the other said jaw so as to bridge across said slit when said jaws are closed.

* * * * *